US008770510B2

(12) United States Patent
Cox et al.

(10) Patent No.: US 8,770,510 B2
(45) Date of Patent: Jul. 8, 2014

(54) REEL FLANGE HAVING AN INCLINED INTERIOR SURFACE

(75) Inventors: Gary L. Cox, Richmond, IN (US); Gerald H. Davis, Fountain City, IN (US)

(73) Assignee: Vandor Corporation, Richmond, IN (US)

( * ) Notice: Subject to any disclaimer, the term of this patent is extended or adjusted under 35 U.S.C. 154(b) by 422 days.

(21) Appl. No.: 13/287,991

(22) Filed: Nov. 2, 2011

(65) Prior Publication Data

US 2012/0104147 A1 May 3, 2012

Related U.S. Application Data

(60) Provisional application No. 61/409,392, filed on Nov. 2, 2010.

(51) Int. Cl.
*B65H 75/14* (2006.01)

(52) U.S. Cl.
USPC ..... 242/614.1; 242/118.4

(58) Field of Classification Search
USPC ..... 242/614–614.1, 118.4
See application file for complete search history.

(56) References Cited

U.S. PATENT DOCUMENTS

| | | | |
|---|---|---|---|
| 2,321,084 | A | 6/1943 | Howsam et al. |
| 2,898,057 | A | 8/1959 | Curry |
| 3,977,429 | A | 8/1976 | Stevenson |
| 4,130,249 | A | 12/1978 | Steinhilber |
| 4,471,920 | A | 9/1984 | Ditton et al. |
| 4,696,438 | A | 9/1987 | Myers |
| 5,330,127 | A | 7/1994 | Haefner |
| 5,868,349 | A | 2/1999 | DesRosiers et al. |
| 5,908,172 | A | 6/1999 | Pierro et al. |
| 6,719,238 | B1 | 4/2004 | Grant et al. |
| 6,991,197 | B2 | 1/2006 | Cox et al. |
| 2008/0156928 | A1 | 7/2008 | Doud et al. |

*Primary Examiner* — William E Dondero
(74) *Attorney, Agent, or Firm* — Maginot, Moore & Beck LLP

(57) ABSTRACT

A flange for a reel for supporting a wound flexible medium includes a plate member and a set of support elements. The reel includes an elongate core defining a longitudinal core axis. The plate member engages the core and extends radially from the core toward an outer edge and has an axially inclined media engaging surface. The set of support elements have a height extending from the plate member in the axial direction, and a length extending radially, at least a first support element extending radially from proximate the core to proximate the outer edge. The axial distance between the plate member and a top of the first support element proximate the outer edge is less than an axial distance between the plate member and the top of the first support element proximate the core.

19 Claims, 4 Drawing Sheets

REEL FLANGE HAVING AN INCLINED INTERIOR SURFACE

This application claims the benefit of U.S. Provisional Patent Application Ser. No. 61/409,392 filed Nov. 2, 2010, which is incorporated herein by reference.

FIELD OF THE INVENTION

The present invention relates generally to reels for supporting wound flexible media such as cable, wire, hose, rope and the like.

BACKGROUND OF THE INVENTION

Reels for supporting wound flexible media are employed to both store and facilitate the dispensing of wound media such as rope, wire, chain, and strings of parts. The essential elements of a reel include its core, around which the flexible medium is wound, and its flanges, which prevent the wound flexible medium from migrating axially off of the core. Reels intended for industrial use can vary greatly in size.

Well-designed reels must combine a high strength-to-weight ratio with low manufacturing cost. One reel design that has gained popularity is a reel in which the core is constructed of either a pressed paperboard material or extruded plastic, and in which the flanges are constructed of a composite or plastic material. The use of paper and plastic components, in general, provides a high strength-to-weight ratio and facilitates the use of relatively straightforward and relatively inexpensive manufacturing techniques. Another lightweight reel design consists of a pressed paperboard core and corrugated paper flanges. While such all-paper reels provide significant economy and light weight, all-paper reels are generally not suitable for certain medium to heavy duty applications because the paper flanges do not have the strength of plastic, wood, or steel flanges. Accordingly, for medium to heavy duty reel applications, plastic or composite flanges provide an advantageous combination of manufacturability, light weight, and strength.

Reels having composite or plastic flanges are relatively simple to manufacture. The flanges may be formed using known injection molding techniques. The flanges are then attached to the core to form a reel.

During use, reels are subject to many extraneous forces which can possibly damage the reels. For instance, a user may grip the reel by one of its flanges and lift the reel off of the floor. If the reel is not carrying any wound media, the reel is less susceptible to damage from such lifting. On the other hand, if the reel is loaded with a heavy metal wound medium, then the weight of the loaded reel can cause the gripped flange to bend and/or warp when the reel is lifted by the flange. In order to avoid damage caused by such lifting, the typical flange is designed with wall thicknesses that are sufficient to provide the necessary strength and structural integrity. Of course, with increased wall thicknesses also comes increased material costs and weight, neither of which is desirable.

Another way in which a reel may be damaged is if an extraneous force is exerted on a flange, such as if the reel is dropped. Such a force exerted on a flange will usually damage the pressed cardboard core. Particularly subject to damage are the ends of the core that engage the flanges. It has been found that an end of a core tends to tear or buckle inwardly when a sufficient force is exerted on the corresponding flange.

What is needed, therefore, is a reel that is less subject to damage from extraneous forces and yet does not require an increased amount of material.

SUMMARY

The invention described herein comprises a reel having a base plate, a core retaining area, and an outer edge defined on the base plate. An inner surface of the base plate extends in a non-planer manner in the radial direction from the core retaining area to the outer edge. In particular, the inner surface of the base plate inclines axially and radially outward from the core retaining area.

In one embodiment, a flange for use in a reel for supporting a wound flexible medium includes a plate member and a set of support elements. The reel includes an elongate core defining a longitudinal core axis. The plate member is configured to engage the core and extends radially from the core toward an outer edge and having an axially inclined media engaging surface that extends in a first axial direction as the plate member extends radially outward. The set of support elements have a height extending from the plate member in the first axial direction, and a length extending radially along at least a portion of the plate member, at least a first support element extending radially from proximate the core to proximate the outer edge. The axial distance between the plate member and a top of the first support element proximate the outer edge is less than an axial distance between the plate member and the top of the first support element proximate the core.

The above described features and advantages, as well as others, will become more readily apparent to those of ordinary skill in the art by reference to the following detailed description and accompanying drawings.

DETAILED DESCRIPTION

Figure 1:
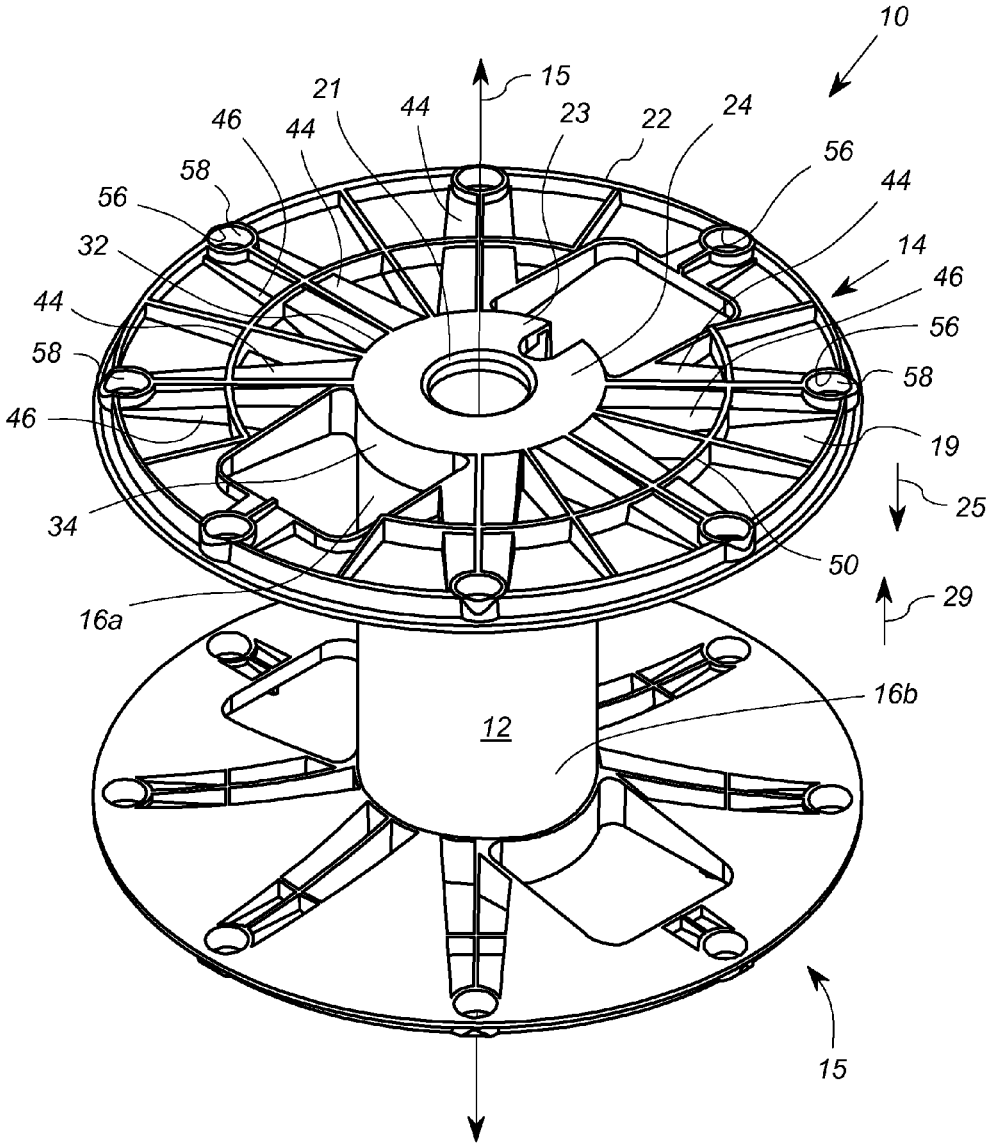
FIG. 1 shows a perspective view of an exemplary embodiment of a reel according to the present invention.
Figure 2:
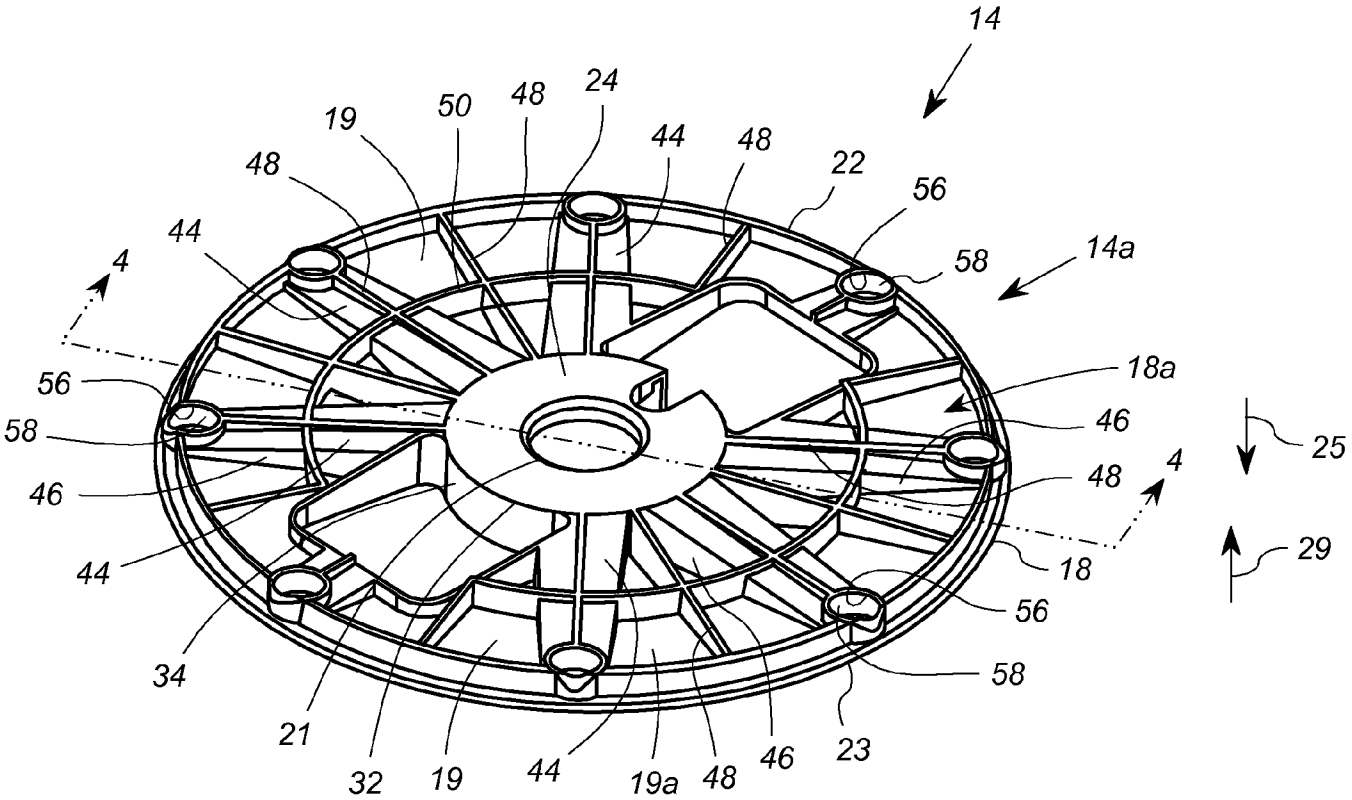
FIG. 2 shows a perspective view of a first side of one of the flanges of FIG. 1.

FIG. 1 shows a perspective view of one embodiment of a reel 10 according to the present invention which includes a core 12, a first flange 14 and a second flange 15. As shown in FIG. 2, the core 12 defines an axis 13 and has two opposite ends 16*a*, 16*b*. When the terms "axial", "radial" or "circumferential" are used herein, it will mean with respect to the axis 13 such that a line or component that is normal to the axis 13 is referred to as "radial", and a line or component that is parallel to the axis 13 is referred to as "axial". A component that extends in an arc or circle at a constant distance from the axis 13 is referred to as "circumferential". A structure that is referred to as extending in an "axial", "radial" or "circumferential" way does not mean that such structure extends exclusively in such a manner, unless stated otherwise, but rather that some non-trivial aspect of the structure extends in a way that includes the stated directional component. It will also be appreciated that any structure described as annular does not necessarily form an uninterrupted annular structure, but rather a structure that is predominantly annular despite one or more interruptions in the annular continuity.

Referring again to the reel 10, the core 12 typically, but not necessarily, has a substantially circular, uniform, cross-sectional shape along its axial length (parallel to axis 13) such that the core 12 assumes the configuration of a hollow cylinder. In the exemplary embodiment described herein, the core 12 can comprise a pressed paperboard tube. In another example, the core 12 can comprise an extruded plastic tube.

The flanges 14, 15 are preferably molded of a plastic or composite material. However, metal and other rigid materials may be used while still retaining many of the advantages of the present invention.

Figure 3:
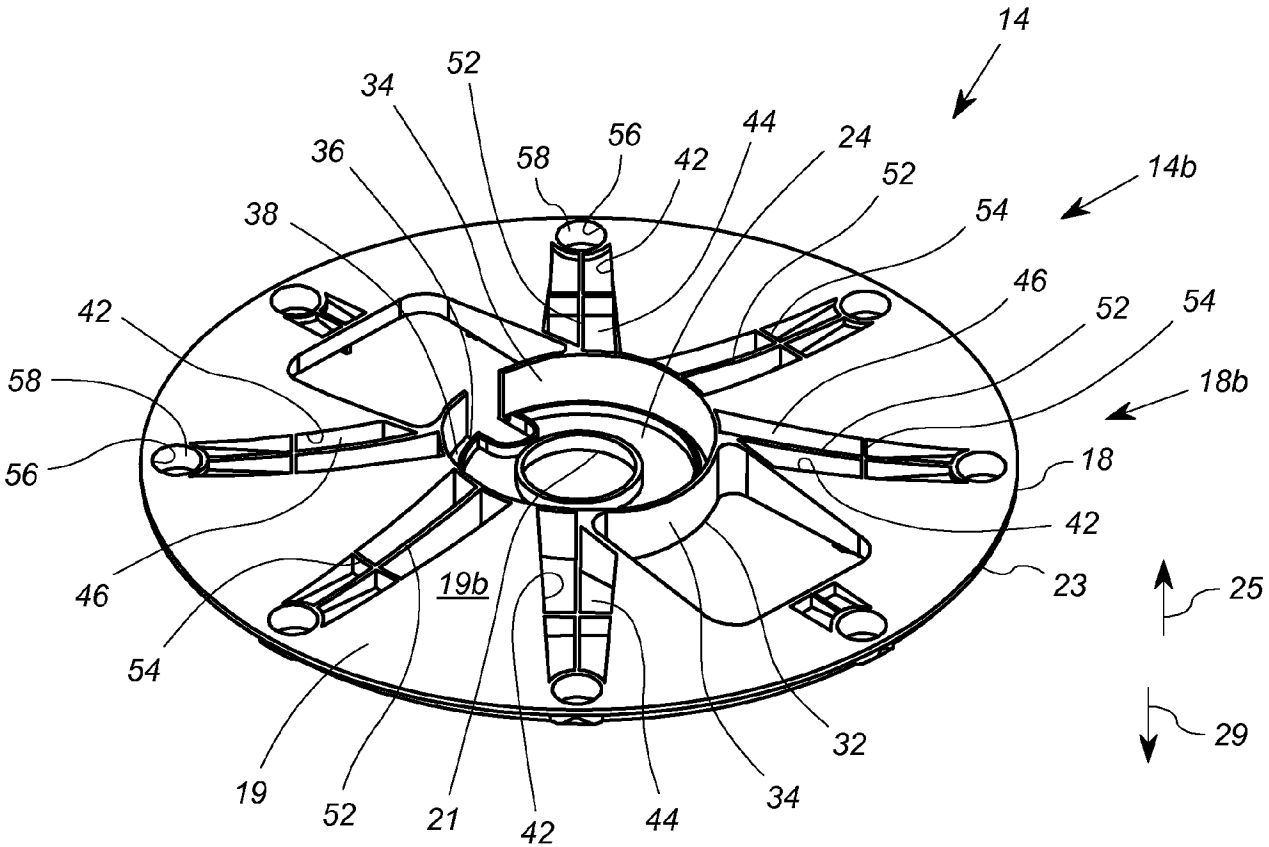
FIG. 3 shows a perspective view of a second side of the flange of FIG. 2.
Figure 4:
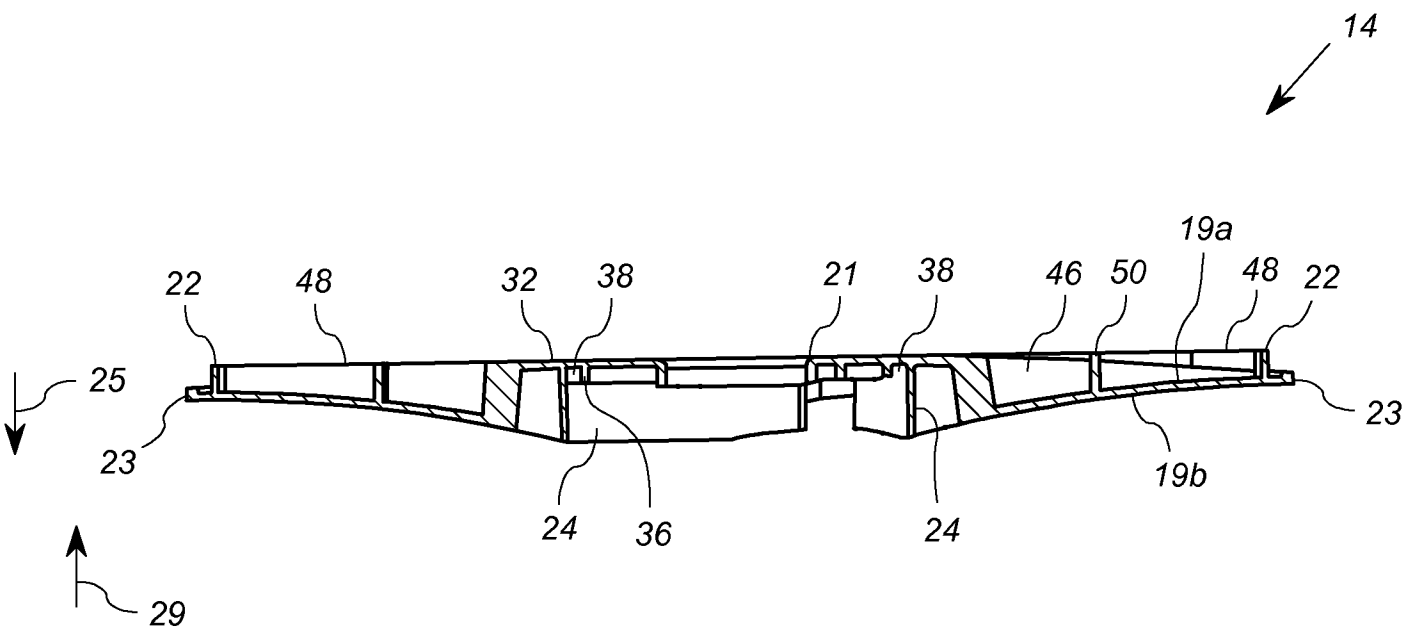
FIG. 4 shows a cutaway side view of the flange of FIG. 2.

FIGS. 2 and 3 show perspective views of first and second sides 14*a*, 14*b*, respectively, of the flange 14. FIG. 4 shows a cutaway side view of the flange 14. With reference to FIGS. 1, 2 and 3, the flange 14 is in the general form of an annulus 18 having first and second sides 18*a*, 18*b*, respectively. The annulus 18 includes a core plate 24 and plate member 19. The annulus 18 also includes a number of surface and structural features formed on the core plate 24 and plate member 19, which are discussed herebelow.

In general, with reference to FIGS. 1 and 3, the core plate 24 is in the form of a small annulus that extends radially from an inner edge 21 to a core edge 32. The core edge 32 has a circumference that corresponds to the circumference of the core 12. As shown in FIGS. 1 and 3, an annular core edge wall 34 extends axially inward (in the direction 25 of FIG. 1) from the core plate 24 at the core edge 32. A second annular core wall 36 also extends axially from the core plate 24 and is disposed concentrically inward of the core edge wall 34, such that the annular core edge wall 34 and the second annular core wall 36 form an annular channel 38 for receiving an edge, not shown, of the core 12.

The base plate 19 includes a first surface 19*a* (see FIGS. 1 and 2) and an opposite second surface 19*b* (see FIG. 3), and extends radially outward from the core edge 32 to an outer edge 23. The second surface 19*b* faces axially inward on the reel 10, and forms a surface that engages and supports any wound media (e.g. cable, rope, wire), not shown, wound on the core 12 during normal use.

In the embodiments described herein, at least the second (media engaging) surface 19*b* of the base plate 19 is flared or inclined such that it also extends axially outward as it extends radially outward. In this embodiment, entire plate member 19, including both the first surface 19*a* and the second surface 19*b*, include the axially outward flare. The angle of flare (axial component versus radial component) is slight, typically less than 10°. Moreover, in the embodiment described herein, the angle of axial inclination of the plate member 19 decreases as a function of radial distance from the core 12, such that the second surface 19*b* appears slightly concave. (See, e.g., FIG. 4) In an alternative version of the flange 14, the angle of axial inclination of the plate member 19 remains substantially constant.

Referring to FIG. 3, the plate member 19 includes a plurality of voids 42 formed as a set of circumferentially dispersed, radially extending voids 42. Each of the voids 42 is covered by a corresponding raised wall 44 that is axially displaced from the plate member 19. As shown in FIGS. 1 and 2 as well as FIG. 3, a set of substantially axially extending connecting walls 46 interconnects each of the raised walls 44 to the plate member 19.

As shown in FIGS. 1-3, an axial distance between the plate member 19 and the raised walls 44 proximate the outer edge 23 is less than an axial distance between the plate member 19 and the raised walls 44 proximate the core 12 or core plate 24. Moreover, the axial distance between the raised walls 44 and the plate member 19 decreases as a function of radial distance from the core 12 or core plate 24. In the embodiment described herein, the decrease in axial distance is a result of the axial inclination of the plate member 19 discussed further above, as well as an axial inclination in the opposite direction of the raised walls 44. In alternative embodiments, the raised walls 44 may suitably extend without appreciable axial inclination.

Accordingly, one feature of the above-described design is that the decreasing axial difference between the raised walls 44 and the plate member 19 creates more flexibility at the radially outward portions of the flange 14 and greater stiffness at the radially inward portions of the flange 14. As a consequence, the flange 14 is able to withstand shock delivered to the edge 23 (as by dropping, for example) in a more advantageous manner. Specifically, the gradual decrease in flexibility radially inward on the flange 14 creates a shock absorption phenomenon that improves flange durability. The gradual decrease in flexibility furthermore creates a failure mechanism that resists cracking at or near the core 12 of the reel 10, which is preferable to failure that extends all of the way to the core 12.

The flange 14 includes additional strengthening features in the form of an outer rim 22, radial ridges 48, an inner rim 50 on the first side 14*a*, and radial ridges 52 and circumferential ridges 54 on the second side 14*b*. The flange 14 further includes a series of circumferentially spaced, circular voids 56 surrounded by perimeter ridges 58.

The outer rim 22 is substantially circular in shape and extends axially in the direction 29 from the first side 19*a* of the plate member 19. The outer rim 22 is disposed in proximity to the outer edge 23. The inner rim 50 is also substantially circular in shape and extends axially in the direction 29 from the first side 19*a* of the plate member 19. The inner rim 50 is disposed concentrically approximately half way between the core edge 32 and the outer edge 23.

The radial ridges 48 are circumferentially dispersed throughout the first side 14*a* of the flange 14, and comprise ridges or ribs having a length that extend in the radial direction with respect to the core 12, and a height that extends primarily in the axial direction 29 from the first surface 19*a* of the plate member 19. To the extent that one or more of the radial ridges 48 correspond in location to the raised walls 44, the corresponding radial ridge 48 extend from the raised wall 44 in the axial direction 29. The radial ridges 48 have an axial height that remains substantially constant. The radial ridges 48 may suitably extend in length from the core edge wall 34 to the outer rim 22.

In the embodiment described herein, the circular voids 56 are relatively small in diameter, being at least an order of magnitude smaller than the diameter of the flange 14. The circular voids 56 are disposed such that they intersect with each of the raised walls 44 and the outer rim 22. The raised perimeters 58 extend from the surface 19*a* of the plate member in the axial direction 29, such that the raised perimeters 58, the radial ridges 48 and the rims 22, 50 all extend to substantially the same height. The circular voids 56 and corresponding raised perimeters 58 provide additional deflection of fracture lines in the flange 14 from the outer edge 23 to the core edge wall 34.

Referring now to FIG. 3, the second side 18*b* of the annulus 18 further includes radial ridges 52 and circumferential ridges 54 that extend in the second axial direction 25 from the underside of the raised walls 44. In particular, in this embodiment, a radial ridge 52 having a radial length between the core edge wall 34 and proximate the outer edge 23, and specifically, the perimeter ridge 58 of the corresponding circular void 56. The circumferential ridges 54 have a circumferential length that spans circumferential width of the corresponding raised walls 44. The circumferential ridges 54 may suitably align with the inner rim 50 of the first side 18*a* of the annulus 18. The ridges 52, 54 in this embodiment provide improved strength.

Referring back to FIG. 1, the second flange 15 preferably has the same shape and structure as the first flange 14.

During assembly, the core 12 is inserted into the annular channel 38 and secured therein by fasteners, adhesive, or spin welding. For example, the core 12 may be secured to the flanges 14, 15 by use of staples. More particularly, staples, not shown, may be driven through the core edge wall 34 into the core 12. Similarly, staples can be driven through the second annular core wall 36 and the core 12.

In another embodiment, the flanges 14, 15 can be attached together by bolts (not shown), thereby securely retaining the core 12 between the flanges 14, 15. The bolts can be inserted through the countersunk bolt holes, not shown, formed in the flange 14 and into correspondingly aligned bolt holes in the flange 15. The ends of the bolts that are opposite the heads of the bolts can be threaded so that the bolts become threadedly coupled to the flange 15.

The use of bolts and staples as securing means allows for the core 12 to be constructed of paper or plastic. Similarly, the use of an adhesive between the core 12 and the flanges 14, 15 allows for the core to be constructed of different materials. In another embodiment, the core 12 is formed of plastic suitable for spin welding the core 12 to the flanges 14, 15. Such techniques are conventional, and disclosed, for example, in U.S. Pat. No. 7,534,316, which is incorporated herein by reference.

It will be appreciated that many modifications may be made to the disclosed embodiments and nevertheless obtain the advantages of the tapered or flared media engaging surface of the annulus. For example, although the inner and outer rims 50, 22 are substantially circular, it will be appreciated that the exact shapes of the rims can be varied depending on the requirements of the application for the reel 10. It will further be appreciated that although the raised wall 44 and corresponding connecting walls 46 form a support structure that is generally U-shaped in cross section, those structures may be replaced by ridges or ribs having a different cross section, such as a V-shaped cross section, or even a single beam or rib. In the latter two embodiments, no flat raised wall is employed.

It will be appreciated that those of ordinary skill in the art may readily devise their own implementations that incorporate the principles of the present invention and fall within the spirit and scope thereof. For example, the number, heights and orientations of the various support ridges, the spacing therebetween, and the patterns formed thereby can all readily be modified without departing from the spirit and scope of the invention. Likewise, the number, heights and orientations of the inner support ridges 40, the spacing therebetween, and the patterns formed thereby can also all readily be modified without departing from the spirit and scope of the invention. Moreover, the heights and spacing between the radially inner wall 30 and the radially outer wall 32 can be modified within the spirit and scope of the invention.

We claim:

1. A flange for use in a reel for supporting a wound flexible medium, the reel including a core defining a longitudinal core axis, the flange comprising:

a plate member configured to engage the core and extending radially from the core toward an outer edge and having an axially inclined media engaging surface that extends in a first axial direction has the plate member extends radially outward, the plate member including a plurality of voids;

a set of raised walls axially displaced from the plate member and extending over said plurality of voids and outward from the core;

a set of connecting walls interconnecting a first raised wall of said set of raised walls and the plate member;

wherein an axial distance between the plate member and the first raised wall at a first radial position proximate the outer edge is less than an axial distance between the plate member and the first raised wall at a second radial position radially inward of the first radial position.

2. The flange according to claim 1, further comprising a first annular rim extending in the first axial direction from the plate member proximate the outer edge.

3. The flange according to claim 1, further comprising:

at least a first support ridge extending in a second axial direction from said first raised wall.

4. The flange according to claim 3, further comprising:

a second support ridge projecting from said plate member in the first axial direction.

5. The flange according to claim 1, wherein each of the set of raised walls has a inclined upper surface that inclines in the second axial direction as each of the set of raised walls extends radially outward.

6. The flange according to claim 1, wherein the media engaging surface has a first angle of axial inclination at a first position proximate the core, and a second angle of axial inclination at a second position proximate the outer edge, the second angle differing from the first angle.

7. The flange according to claim 6, wherein the first angle exceeds the second angle.

8. A flange for use in a reel for supporting a wound flexible medium, the reel including an elongated core defining a longitudinal core axis, the flange comprising:

a plate member configured to engage the core and extending radially from the core toward an outer edge and having an axially inclined media engaging surface that extends in a first axial direction as the plate member extends radially outward;

a set of support ridges having a height extending from the plate member in the first axial direction, and a length extending radially along at least a portion of the plate member, at least a first support ridge extending radially from proximate the core to proximate the outer edge;

wherein an axial distance between the plate member and a top of the first support ridge proximate the outer edge is less than an axial distance between the plate member and the top of the first support ridge proximate the core.

9. The flange according to claim 8, wherein the plate member includes voids extending through the media engaging surface.

10. The flange according to claim 9, further comprising at least one wall extending over the voids, the at least one wall axially spaced apart from the plate member.

11. The flange according to claim 10, wherein further comprising at least one connecting wall between the at least one wall and the plate member.

12. The flange according to claim 10, further comprising:

at least a first support ridge extending in a second axial direction from said at least one wall.

13. The flange according to claim 12, further comprising:

a second support ridge projecting from said plate member in the first axial direction.

14. The flange according to claim 10, wherein that at least one wall has a inclined upper surface that inclines in the first axial direction as the at least one wall extends radially outward.

15. The flange according to claim 8, wherein the media engaging surface has a first angle of axial inclination at a first position proximate the core, and a second angle of axial inclination at a second position proximate the outer edge, the second angle differing from the first angle.

16. The flange according to claim 15, wherein the first angle exceeds the second angle.

17. A reel apparatus, comprising:

a core configured to receive wound flexible media and defining a core axis, the core coupled between a first flange and a second flange;

wherein the first flange comprises a plate member configured to engage the core and extending radially from the core toward an outer edge and having an axially inclined media engaging surface that extends in a first axial direction as the plate member extends radially outward, a set of support ridges having a height extending from the plate member in the first axial direction, and a length extending radially along at least a portion of the plate member, at least a first support ridge extending radially from proximate the core to proximate the outer edge, and wherein an axial distance between the plate member and a top of the first support ridge proximate the outer edge is less than an axial distance between the plate member and the top of the first support ridge proximate the core.

18. The reel according to claim 17, wherein the media engaging surface has a first angle of axial inclination at a first position proximate the core, and a second angle of axial inclination at a second position proximate the outer edge, the second angle differing from the first angle.

19. The flange according to claim 18, wherein the first angle exceeds the second angle.

* * * * *